US006932626B2

(12) United States Patent
Costello et al.

(10) Patent No.: US 6,932,626 B2
(45) Date of Patent: Aug. 23, 2005

(54) ELECTRICAL CARD CONNECTOR

(75) Inventors: Brian Patrick Costello, Scotts Valley, CA (US); Justin Shane McClellan, Camp Hill, PA (US); Wing Lian Choo, Singapore (SG)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/610,131

(22) Filed: Jun. 30, 2003

(65) Prior Publication Data

US 2004/0266231 A1 Dec. 30, 2004

(51) Int. Cl.[7] ..... H01R 4/66

(52) U.S. Cl. ..... 439/108; 439/946; 439/76.1; 361/737

(58) Field of Search ..... 439/108, 607, 439/946, 76.1, 95; 361/737

(56) References Cited

U.S. PATENT DOCUMENTS 5,833,473 A * 11/1998 Betker et al. ..... 439/76.1
5,890,917 A * 4/1999 Ishida et al. ..... 439/101
5,893,766 A * 4/1999 Bellas et al. ..... 439/95
5,934,941 A * 8/1999 Hirai et al. ..... 439/607
5,940,275 A * 8/1999 Laity ..... 361/737
6,004,144 A * 12/1999 Yeh et al. ..... 439/76.1
6,068,500 A * 5/2000 Kantner ..... 439/218
6,071,130 A * 6/2000 Johnson ..... 439/92
6,089,882 A * 7/2000 Costello ..... 439/95
6,115,257 A * 9/2000 Laity ..... 361/737
6,181,564 B1 * 1/2001 Furusho ..... 361/737
6,186,801 B1 * 2/2001 Kakinoki ..... 439/95
6,213,790 B1 * 4/2001 Kakinoki et al. ..... 439/95
6,247,967 B1 * 6/2001 Wu et al. ..... 439/607
6,257,905 B1 * 7/2001 Johnson ..... 439/95
6,330,163 B1 * 12/2001 Bates et al. ..... 361/737
6,474,998 B1 * 11/2002 Takeuchi ..... 439/76.1
6,639,805 B1 * 10/2003 Chen ..... 361/737
6,641,409 B1 * 11/2003 Gu ..... 439/76.1
6,685,509 B1 * 2/2004 Yeh ..... 439/607
6,793,508 B2 * 9/2004 Chang ..... 439/95
6,824,969 B1 * 11/2004 Ko ..... 439/680

* cited by examiner

*Primary Examiner*—Ross Gushi

(57) ABSTRACT

A receptacle assembly includes a main housing having a header interface end configured to mate with a header assembly. The main housing has a board reception end that retains a plurality of electrical contacts arranged in at least two parallel rows. At least two rows of the electrical contacts are configured to contact one surface of a circuit card while at least one row of electrical contacts is configured to contact an opposite surface of the circuit card. The receptacle assembly may also include at least one ground shield that at least partially covers the main housing.

12 Claims, 7 Drawing Sheets

ELECTRICAL CARD CONNECTOR

BACKGROUND OF THE INVENTION

The present invention generally relates to an electrical connector and more particularly relates to a shielded connector that may be used with a PC card Various electronic systems, such as computers, comprise a wide array of components mounted on printed circuit boards, such as daughterboards and motherboards, which are interconnected to transfer signals and power throughout the system. The transfer of signals and power between the circuit boards requires electrical interconnection between the circuit boards.

Personal computer cards (PC cards) are used with various computers (including laptop computers) to provide flexibility and interchangeability for upgrading a computer. Typically, PC cards offer an add-on functionality, such as an increased rate of processing, encryption, etc., to the computer. Further, PC cards are removable, thereby allowing a user to easily upgrade a computer by simply changing to a new PC card.

As technology progresses, however, the demand for additional power and signal capacity within computer systems increases. Currently, conventional PC cards do not offer enough signal and power capacity for some high tech and rigorous applications. That is, the number of signal and power contacts within the PC cards are not sufficient for these applications. In the future, the demands for power and signal capacity will continue to increase.

Additionally, increased power and signal requirements within a system increase the potential for electrostatic discharge, electromagnetic interference, and other such phenomena within the system. Typical electrical connectors that connect a PC card to a circuit board (or the like) do not offer sufficient protection against such phenomena.

Thus, a need exists for a connector that houses more contacts, thereby allowing greater signal and power transmission between a circuit board and a PC card. A need also exists for a connector that reduces the risk of electrostatic discharge, interference and the like.

BRIEF SUMMARY OF THE INVENTION

Embodiments of the present invention provide an electrical connector, comprising a header assembly configured to be mounted on a first circuit board and a receptacle assembly configured to mate with a second circuit board. The receptacle assembly includes a main housing, electrical contacts, first and second ground shields and at least one ground contact member.

The main housing of the receptacle assembly includes a top surface, a bottom surface, a header interface end having a plurality of contact cavities, and a board reception end having a plurality of contact receptacles. Each of the contact receptacles communicates with a corresponding contact cavity. Each electrical contact is retained within a contact receptacle.

The first and second ground shields have shield strips that overlie the top and bottom surfaces, respectively. The ground contact member is configured to connect at least one of the first and second ground shields to a second circuit board.

The ground contact member, which is aligned with the electrical contacts, may include a ground tail extending outwardly from one of the shield strips. Optionally, the ground contact member may include a ground clasp attached to one of the shield strips. The ground clasp is bent to extend into a corresponding contact receptacle and interconnects one of the shield strips to an electrical contact extending outwardly from one of the contact receptacles.

The electrical contacts may be arranged in at least three parallel rows. At least two rows of the electrical contacts are configured to contact one surface of a circuit card while at least one row of the electrical contacts is configured to contact an opposite surface of the circuit card

Figure 1:
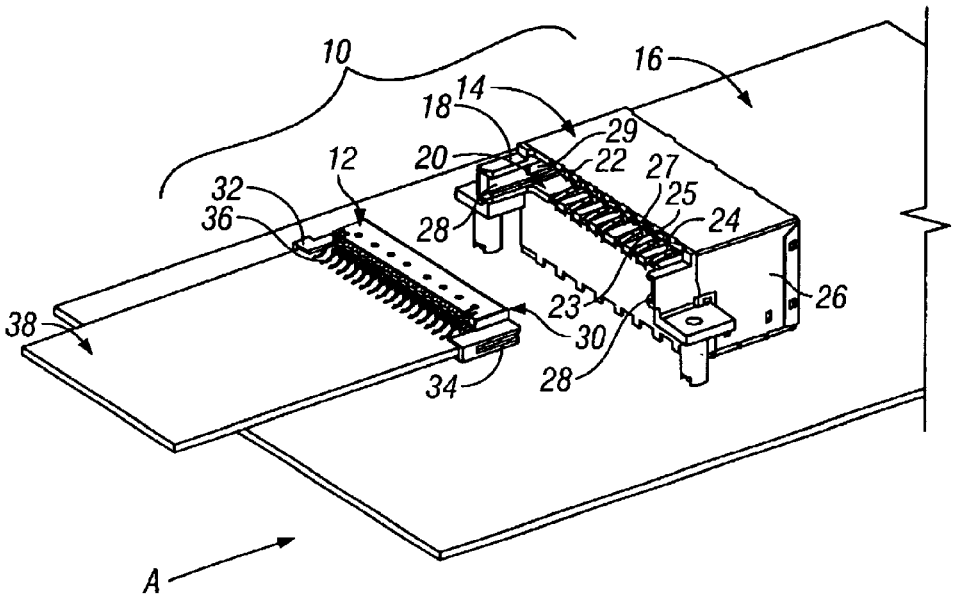
FIG. 1 illustrates a rear isometric view of a PC card connector in a pre-mated position according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

FIG. 1 illustrates a rear isometric view of a PC card connector 10 in a pre-mated position according to an embodiment of the present invention. The connector 10 includes a receptacle assembly 12 that is configured to mate with a header assembly 14, which is mounted on a motherboard or printed circuit board 16. The header assembly 14 includes a receptacle interface end 18 that includes a cavity 20 configured to receive and retain the receptacle assembly 12. The cavity 20 is closed by side walls 26, upper walls 22, and a lower shelf 24. The lower shelf 24 includes notches cut therein to receive ground contacts 25. The upper wall 22 includes ground tabs 23 bent into the cavity 20. The ground tabs 23 and ground contacts 25 engage grounding surfaces on the receptacle assembly 12. Electrical pins 27 extend outwardly within the cavity 20 and are configured to mate with the receptacle assembly 12. The side walls 26 include guide channels 28 formed therein that are configured to slidably receive and retain the receptacle assembly 12. The guide channels 28 have protrusions 29 formed thereon that engage corresponding channels formed within lateral guide beams 34 on the receptacle assembly 12.

The receptacle assembly 12 includes a header interface end 30 and a card reception end 32. The receptacle assembly 12 is inserted into the header assembly 14 in the direction of line A so that the header interface end 30 is mated into the cavity 20 of the header assembly 14. During insertion of the receptacle assembly 12 into the cavity 20, the lateral guide beams 34 of the receptacle assembly 12 are slidably received by the guide channels 28 of the header assembly 14. The card reception end 32 includes contact tails 36 extending therefrom that electrically connect to a daughtercard or PC card 38.

Figure 2:
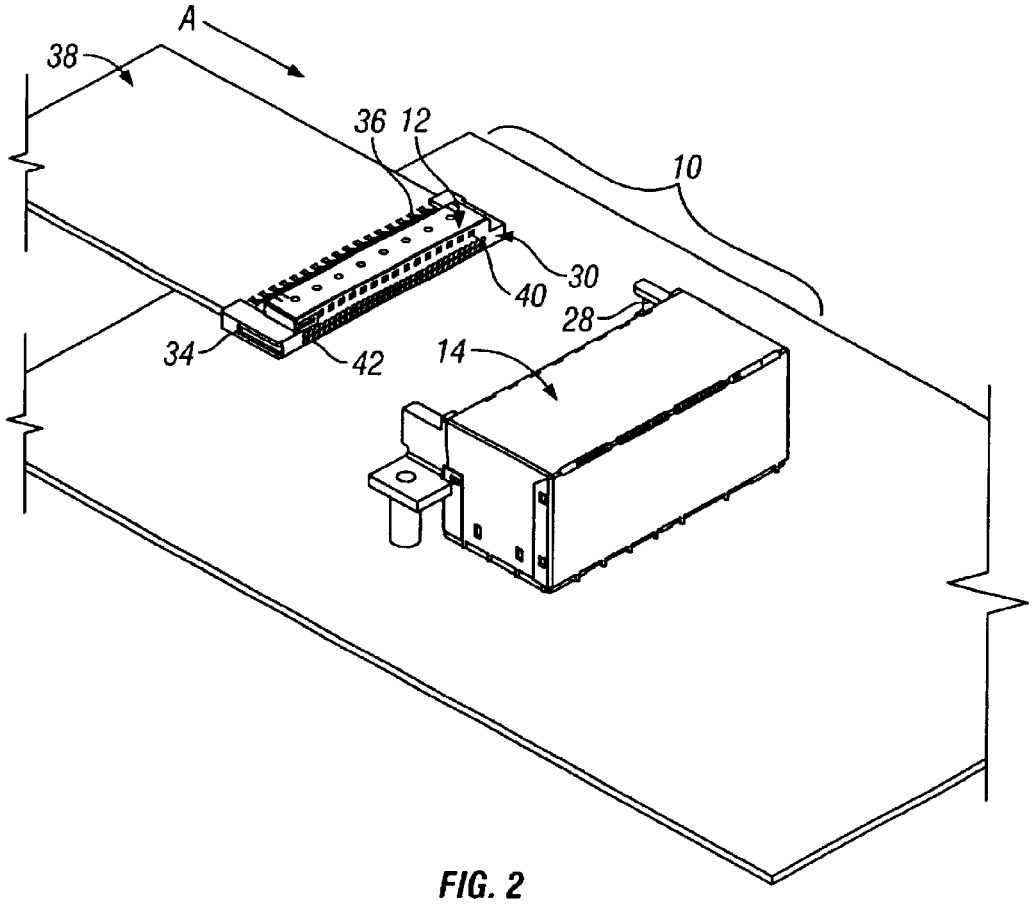
FIG. 2 illustrates a front isometric view of a PC card connector in a pre-mated position according to an embodiment of the present invention.

FIG. 2 illustrates a front isometric view of the connector 10 in a pre-mated position to better show cavities 40 and 42 that are formed within the header interface end 30 of the receptacle assembly 12. The cavities 40 and 42 contain contacts, pins or traces that are configured to convey data signals or power. The cavities 40 may be configured to receive corresponding power contact pins of the header assembly 14, while the cavities 42 may be configured to receive corresponding signal contact pins of the header assembly 14. Optionally, the cavities 40 or 42 may receive power or signal contact pins.

The cavities 40 are arranged in a row across the header interface end 30. The cavities 42 are oriented in two rows that are both parallel to the row of conductive cavities 40. The cavities 40 may be configured to receive a first set of pins within the header connector 14, while the cavities 42 may be configured to receive a second set of pins within the header connector 14. Thus, as shown in FIG. 2, three parallel rows of cavities 40 and 42 are arranged on the header interface end 30.

Figure 3:
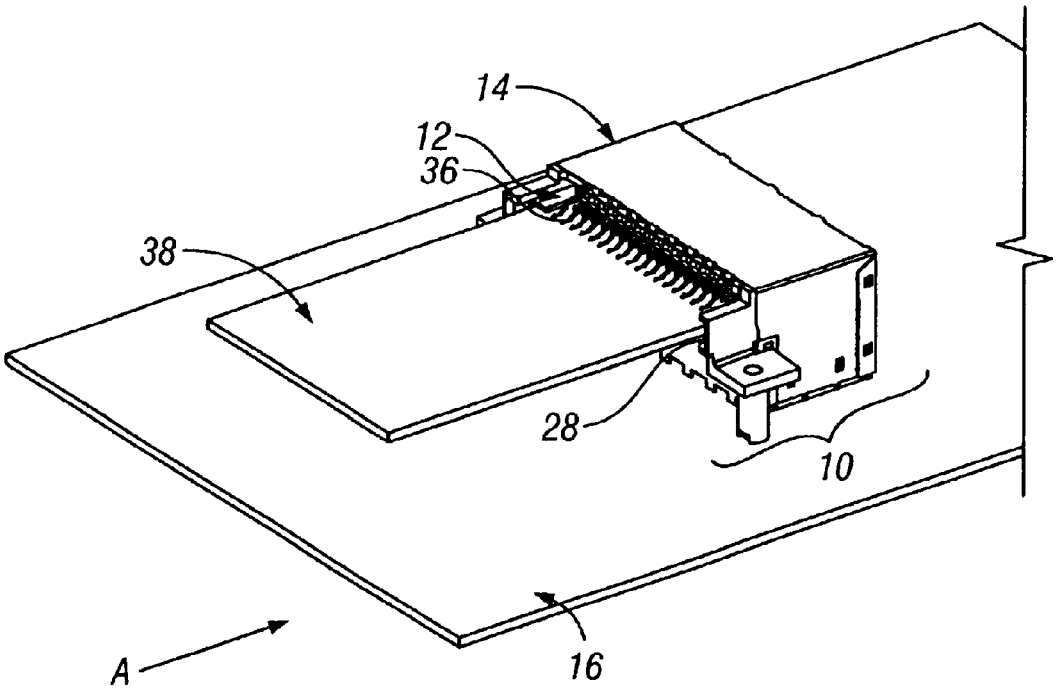
FIG. 3 illustrates an isometric view of a fully assembled PC card connector according to an embodiment of the present invention.

FIG. 3 illustrates an isometric view of the receptacle assembly 12 fully mated into the header assembly 14 in the direction of line A. Power and signals may pass between the printed circuit board 16 and the PC card 38 through the connector 10.

Figure 4:
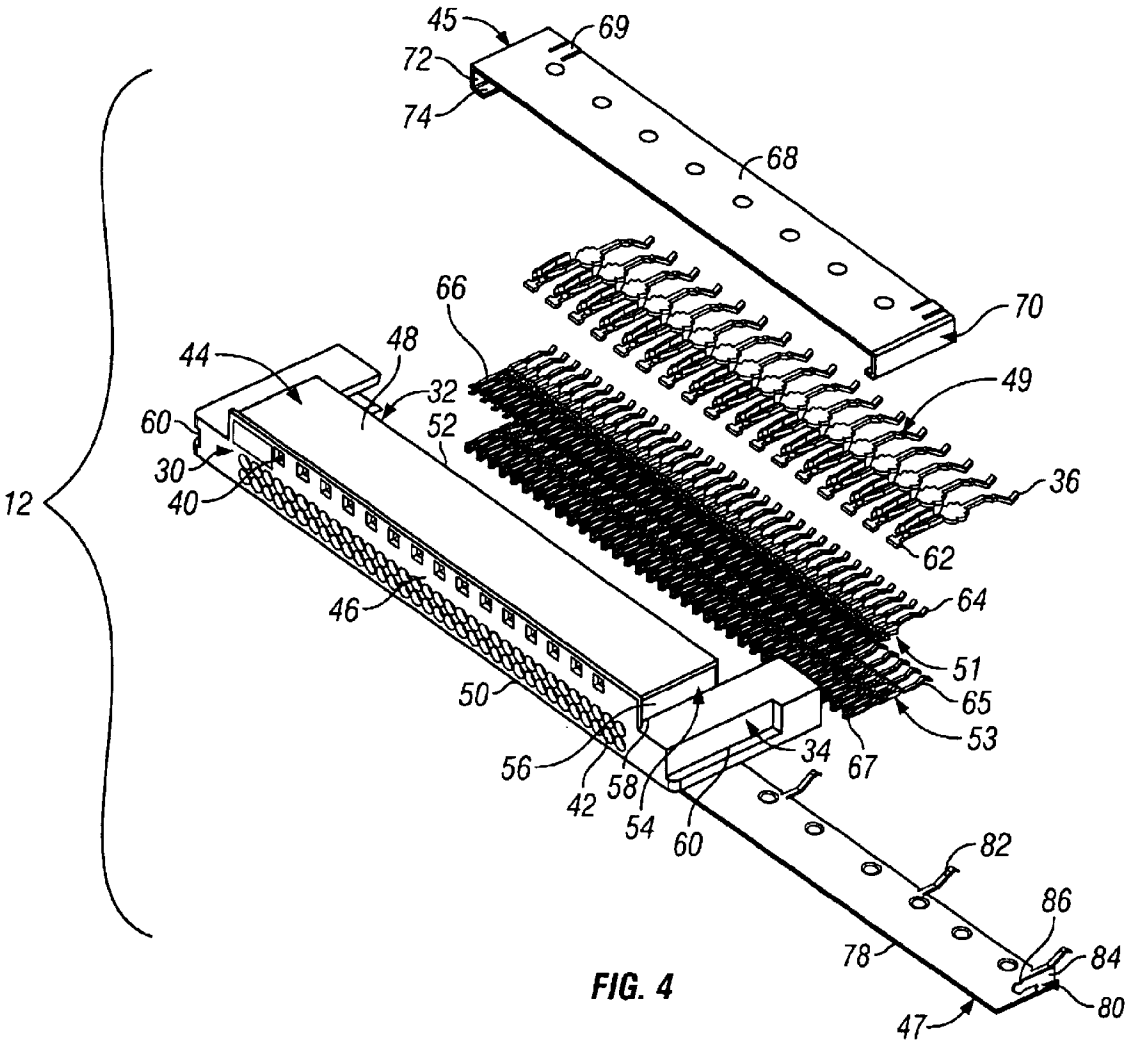
FIG. 4 illustrates an exploded isometric view of a receptacle assembly according to an embodiment of the present invention.

FIG. 4 illustrates an exploded isometric view of the receptacle assembly 12. The receptacle assembly 12 includes a main housing 44, an upper ground shield 45, a lower ground shield 47, and arrays of contacts 49, 51 and 53. The main housing 44 includes a front face 46 (on the header interface end 30), a top surface 48, a bottom surface 50, a contact reception surface 52 (proximate the card reception end 32) and lateral walls 54. The lateral walls 54 include upper portions 56 and the lateral guide beams 34, which are positioned below the upper portions 56. The lateral guide beams 34 protrude outwardly from the lateral walls 54. Slots 58 are formed between the upper portions 56 and the lateral guide beams 34. The lateral guide beams 34 include channels 60 that are configured to mate with corresponding protrusions 29 within the guide channels 28 (shown in FIG. 1) of the header assembly 14.

The cavities 40 and 42 extend from the front face 46 to the contact reception surface 52 and receive and retain corresponding contacts 49, 51 and 53. Each of the contacts 49 includes a contact tail 36 formed integrally with a retained end 62. The retained end 62 is housed within a corresponding cavity 40 and is configured to mate with a signal or power contact pin of the header assembly 14. Similarly, each contact 51 and 53 includes a contact tail 64 and 65, respectively, formed integrally with a retained end 66 and 67, respectively. The retained ends 66 and 67 are housed within corresponding cavities 42 and configured to mate with a signal or power contact pin of the header assembly 14.

The upper ground shield 45 includes a shield strip 68 formed integrally with housing securing members 70, which are positioned at opposite longitudinal ends of the shield strip 68. The shield strip 68 includes ground clasps 69, notched thereon proximate the housing securing members 70. Optionally, more or fewer ground clasps 69 may be formed anywhere on the shield strip 68. Each housing securing member 70 includes a wall 72 that is oriented perpendicular to the plane of the shield strip 68 and a tab 74 integrally formed with the wall 72. Each tab 74 is bent back under and parallel to the shield strip 68.

Figure 5:
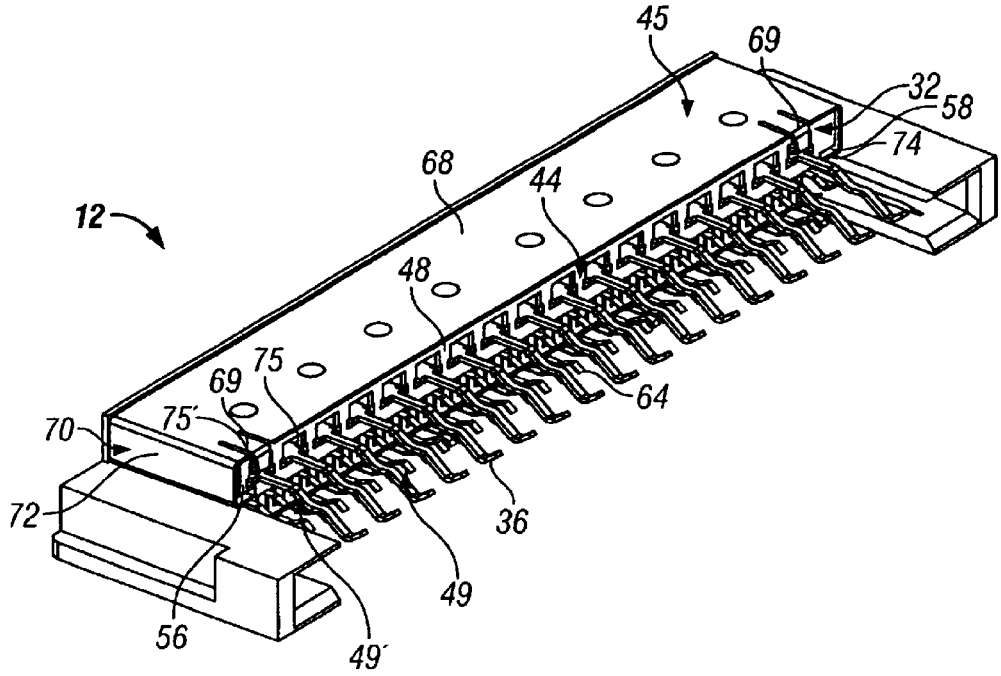
FIG. 5 illustrates an isometric view of the receptacle assembly of FIG. 4 fully assembled.

FIG. 5 illustrates an isometric view of the receptacle assembly 12. The upper ground shield 45 is mounted over the top surface 48 of the main housing 44. The shield strip 68 covers the top surface 48, while the walls 72 cover the upper portions 56. The tabs 74 are received and retained within the slots 58, thereby securing the upper ground shield 45 to the main housing 44. The upper ground shield 45 may be snapably, latchably, or otherwise removably secured to the main housing 44.

As shown in FIG. 5, the card reception end 32 of the receptacle assembly 12 includes contact receptacles 75 from which the contact tails 36 outwardly extend. The upper ground shield 45 also includes the ground clasps 69 that extend outwardly and downwardly from the shield strip 68. The clasps 69 are positioned within outer contact receptacles 75' and engage outer contacts 49', thereby electrically connecting the shield strip 68 to the outer contacts 49'. The outer contacts 49' join ground traces or pads on the PC cards 38 when the PC card 38 is inserted into the card reception end 32.

Referring again to FIG. 4, the lower ground shield 47 includes a shield strip 78 formed integrally with hooks 80 located at either end of the shield strip 78. Each hook 80 includes an upright member 84 that extends upwardly from the shield strip 78 such that the upright member 84 is oriented perpendicular to the plane of the shield strip 78. A beam 86 extends outwardly from the upright member 84 towards the header interface end 30 of the main housing 44. A barb is formed on the tip of the beam 86. The hooks 80 are configured to be received and retained within corresponding ground shield securing receptacles (not shown) within the main housing 44. The lower ground shield 47 also includes ground tails 82 extending outwardly therefrom proximate the card reception end 32. Alternatively, the lower ground shield 47 may include clasps similar to the clasps 69 of the upper ground shield 45. The ground tails 82 are bent to project out of the plane of the shield strip 78 to align with the contact tails 64 on the contacts 53.

Figure 6:
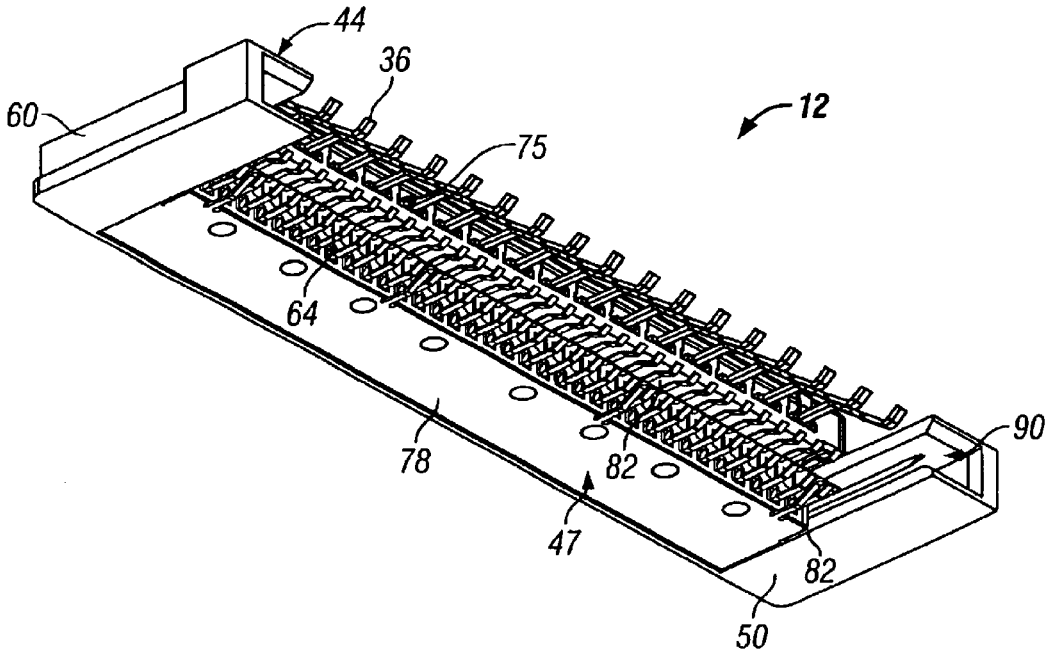
FIG. 6 illustrates an isometric bottom view of the receptacle assembly of FIG. 5.

FIG. 6 illustrates an isometric bottom view of the receptacle assembly 12. The bottom surface 50 of the main housing 44 includes a recessed area (covered by the shield strip 78 of the lower ground shield 47) that receives the shield strip 78 of the lower ground shield 47. The hooks 80 are received within corresponding channels (not shown) formed within the main housing 44, and are retained in the channels by the barbs on the beams 86, thereby securing the lower ground shield 47 to the main housing 44.

The main housing 44 also include card slots 90 formed therein and facing one another. The card slots 90 are configured to receive and retain lateral edges of the PC card 38. As described below, the PC card 38 is positioned with contacts 49 and 51 on one side and contacts 53 on the opposite side.

Figure 7:
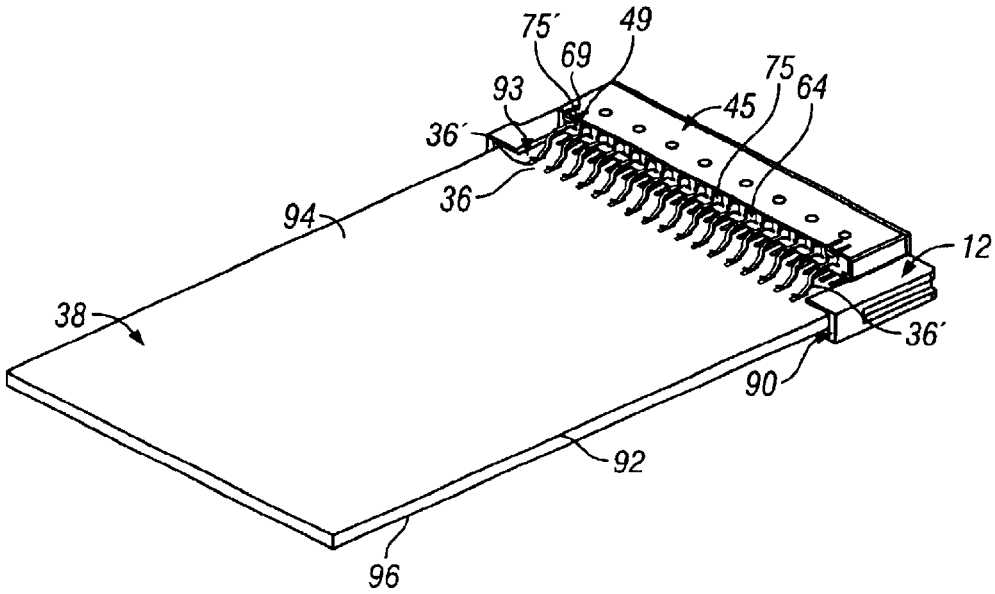
FIG. 7 illustrates an isometric top view of a receptacle assembly retaining a PC card according to an embodiment of the present invention.

FIG. 7 illustrates an isometric top view of the receptacle assembly 12 retaining the PC card 38. Portions of the lateral edges 92 of the PC card 38 are received and retained by the card slots 90 in the main housing 44. A leading end 93 of the PC card 38 is sandwiched between contacts 49, 51 and 53. Upper rows of contact tails 36 and 64 on the contacts 51 and 49 are positioned above, and in contact with, contact pads (not shown) formed on a top surface 94 of the PC card 38. A lower row of contact tails 63 (shown in FIG. 4) abut, contact or otherwise engage a row of contact pads (not shown) formed on a bottom surface 96 of the PC card 38. The contact pads of the PC card 38 may be electrically connected to traces (not shown) that may in turn be electrically connected to components of the PC card 38. Thus, the PC card 38 is sandwiched between two rows of contact tails 36 and 64 on the top surface 94, and one row of contact tails 63 on the bottom surface 96.

Optionally, more or fewer rows of the contacts 49 and 51 may abut the top surface 94 of the PC card 38. Similarly, more or no rows of contacts 53 may abut the bottom surface 96 of the PC card 38. Also, a lower row of contact tails similar to contact tails 36 may abut the lower surface 96. Overall, the leading end 93 of the PC card 38 may contact more or fewer than three rows of contacts 49, 51 and 53.

As shown in FIG. 7, because the ground clasps 69 protrude into the contact receptacles 75' thereby contacting interior wall(s) that define the contact receptacles 75', the outer contact tails 36' effectively become ground tails. As discussed above, ground tails, such as ground tails 82, may extend from the upper ground shield 45 and contact the PC card 38. While not shown, the ground tails 82 on the lower ground shield 47 engage contact pads formed on the bottom surface 96 of the PC card 38.

Thus, the receptacle assembly 12 provides more contacts due to the multiple rows of contacts 49, 51 and 53. More contacts allow for more power and additional signal lines to travel between the PC card 38 and the printed circuit board 16. Also, the receptacle assembly 12 provides added protection against electrostatic discharge, electrical interference and the like between the receptacle assembly 12 and the header assembly 14 (and/or other components within a confined space, such as a central processing unit of a personal computer) due to the upper and lower ground shields 45 and 47.

Figure 8:
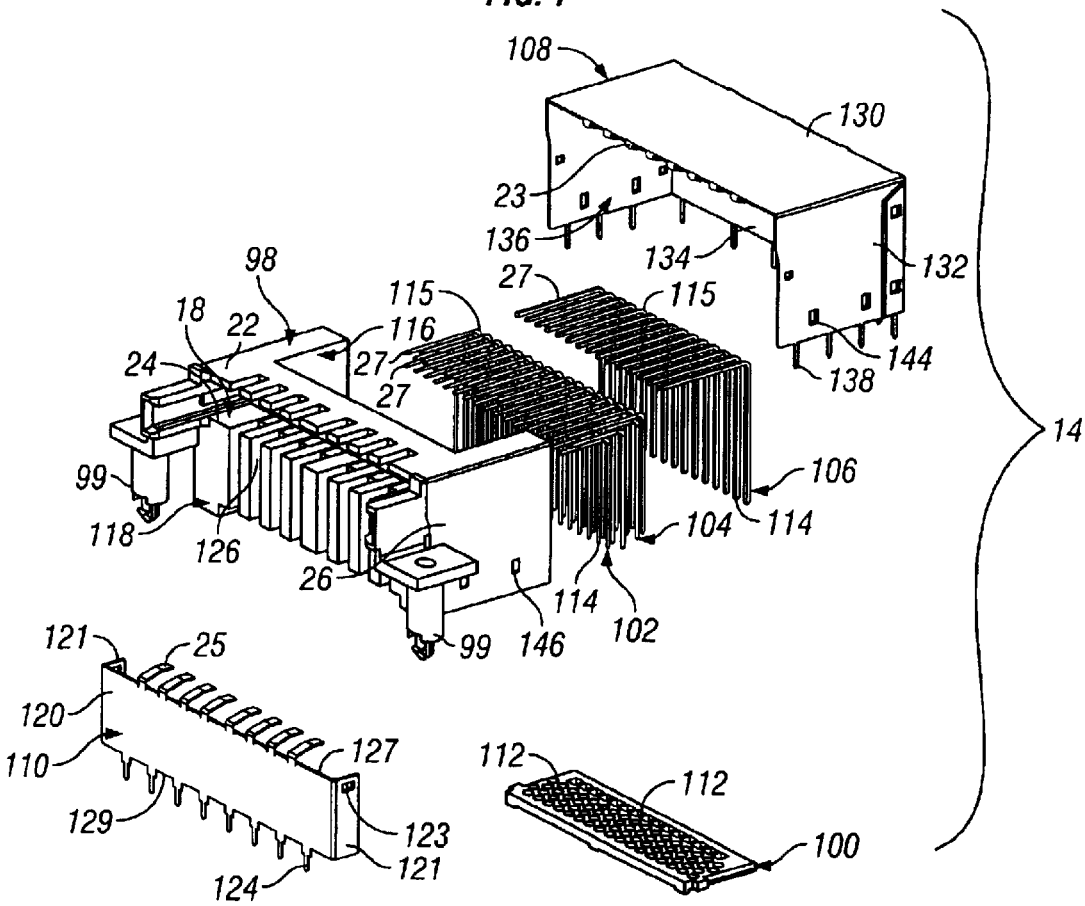
FIG. 8 illustrates an exploded isometric view of a right-angled header assembly according to an embodiment of the present invention.

FIG. 8 illustrates an isometric exploded view of the header assembly 14. As shown in FIG. 8, the header assembly 14 is a right-angled assembly. The header assembly 14 includes a main housing 98, a pin organizer 100, a first array of contacts 102, a second array of contact 104, a third array of contacts 106, an upper shield 108 and a front shield 110. The pin organizer 100 may be connected onto or into the main housing 98. The pin organizer 100 may form a portion of the base of the header assembly 14. The pin organizer 100 includes a plurality of contact receptacles 112 formed therethrough. The contact receptacles 112 allow board contact ends 114 to pass therethrough so as to connect to corresponding structures formed in the printed circuit board 16.

The contacts 102, 104 and 106 are formed as right-angled contacts and correspond to the number of contacts 49 and 51 housed within the receptacle assembly 12. The contacts 102, 104 and 106 are mounted to and secured within the main housing 98. The board contact ends 114 of the contacts 102, 104 and 106 are each integrally formed with right-angled transition portions 115, which are in turn integrally formed with the pins 27. At least some of the pins 27 are exposed within the cavity 20 (shown in FIG. 1) in order to mate with the cavities 40 and 42 formed within the header interface end 30 of the receptacle assembly 12.

The header assembly 14 includes the receptacle interface end 18 and a contact retention chamber 116. The cavity 20 shown in FIG. 1 is defined between an upper surface 22 of the main housing 98, the lower shelf 24, which defines an upper surface of a central interior portion 118, side walls 26, and a rear surface (not shown). Electrical pins 27 extend outwardly from the rear surface and are configured to mate with conductive cavities 40 and 42 (shown above with respect to FIG. 2) formed within the receptacle assembly 12. At least some of the pins 27 are supported by the lower shelf 24 of the central interior portion 118. The header assembly 14 also includes board lock members 99 extending outwardly and downwardly from the side walls 26. The board lock members 99 are configured to be snapably retained within board lock receptacles (not shown) formed in the printed circuit board 16.

The front shield 110 is securably positioned over the central interior portion 118. The front shield 110 includes a main body 120 having folded portions 121 that overlay side walls of the central interior portion 118 of the main housing 98. Latch receptacles 123 are formed within the folded portions 121 and may engage latch members (not shown) formed on side walls of the central interior portion 118. Ground contacts 25 extend outwardly from a top edge 127 of the main body 120 and are configured to fit within portions of ground channels 126 formed in the central interior portion 118. Upon full assembly of the connector 10, the ground contacts 25 may contact the bottom surface 96 of the PC card 38. Ground pins 124 extend downwardly from a lower edge 129 of the main body 120 and are configured to be received and retained within receptacles formed in the printed circuit board 16.

The upper shield 108 mounts over the main housing 98 and the contacts 102, 104 and 106. The upper shield 108 includes a top surface 130, side walls 132 and a rear wall 134 that define an open area 136 configured to receive the main housing 98. Ground pins 138 extend downwardly from lower edges of the side walls 132 and rear walls 134. The ground pins 138 are configured to be received and retained within receptacles (not shown) formed within the printed circuit board 16. Additionally, ground tabs 23 are formed on the underside of the top surface 130 and are configured to fit within portions of ground channels 142 formed within the top surface 22 of the main housing 98. Upon full assembly of the connector 10, the ground tabs 23 may contact the top surface 94 of the PC card 38. The side walls 132 include latch receptacles 144 formed therethrough that engage latch members 146 formed on the side walls 26 of the main housing 98 in order to latchably secure the upper shield 108 to the main housing 98.

Figure 9:
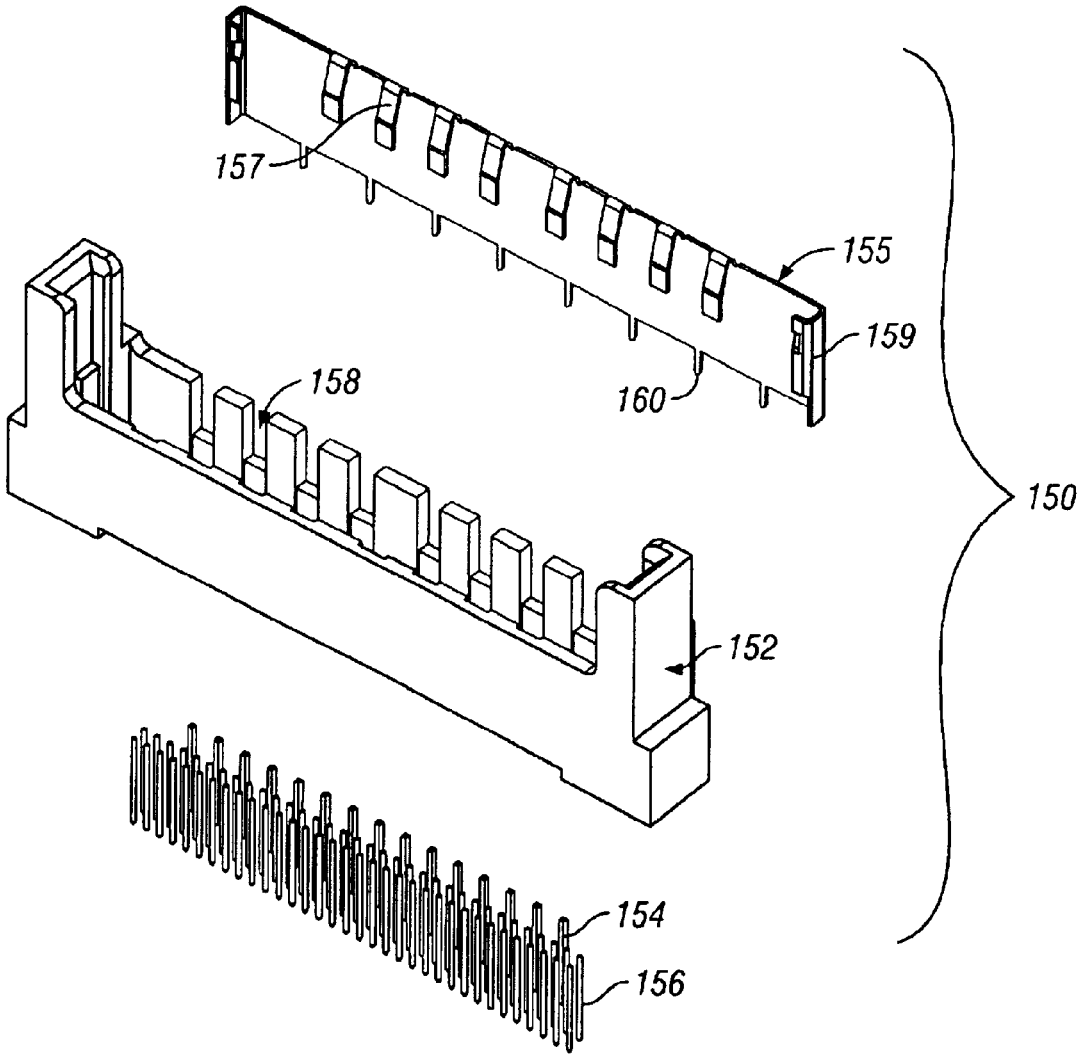
FIG. 9 illustrates an exploded isometric view of a straight-line header assembly according to an alternative embodiment of the present invention.

FIG. 9 illustrates an isometric exploded view of a header assembly 150 according to an alternative embodiment of the present invention. The header assembly 150 includes a main body 152 that houses a plurality of straight contacts 154 and 156. A ground shield 155 is secured to a portion of the main body 152 through folded portions 159 that engage the main body 152. The ground shield 155 includes contact tails 157 that are configured to be retained within corresponding channels 158 formed within the main body 152. The ground shield 155 also includes ground pins 160 extending downwardly therefrom that are configured to be received and retained within receptacles (not shown) formed within the printed circuit board 16. Optionally, the header assembly 150 may include an additional ground shield.

Figure 10:
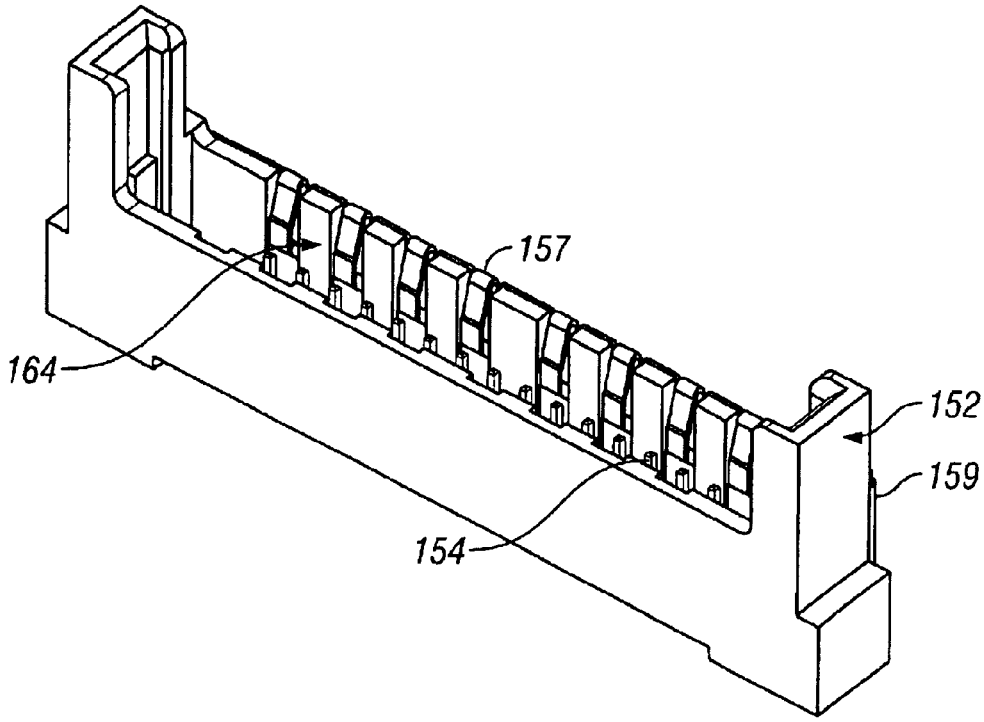
FIG. 10 illustrates an isometric top view of the header assembly of FIG. 9.

FIG. 10 illustrates an isometric top view of the header assembly 150 according to an alternative embodiment of the present invention. The header assembly 150 includes a receptacle interface end 164 that receives and retains the header interface end 30 of the receptacle assembly 12.

Figure 11:
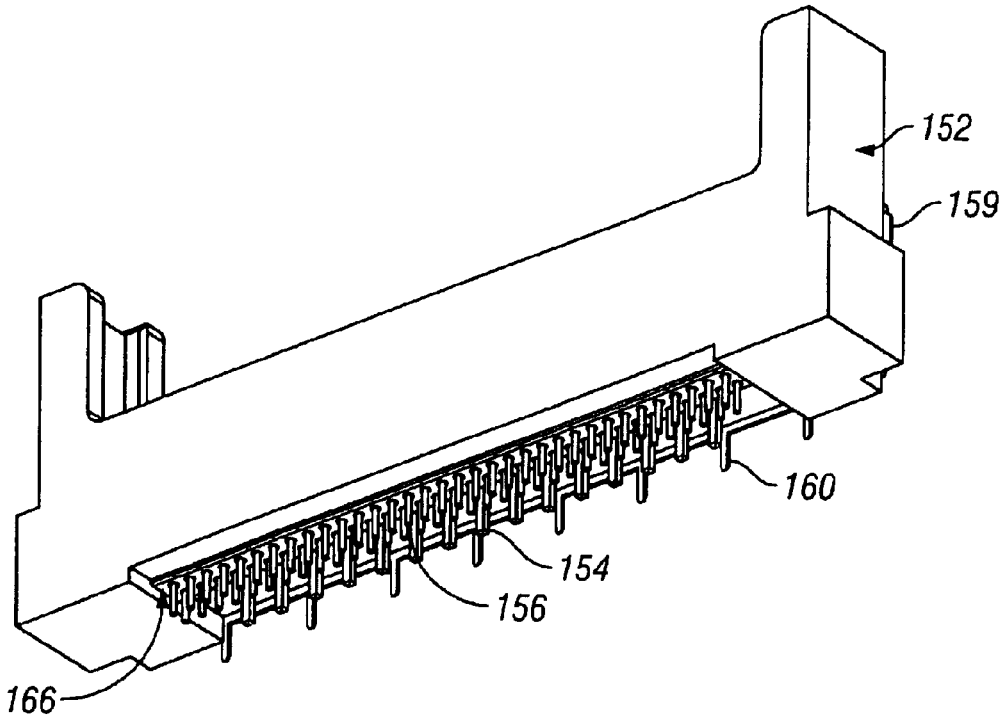
FIG. 11 illustrates an isometric bottom view of the header assembly of FIG. 9.

FIG. 11 illustrates an isometric bottom view of the header assembly 150 according to an alternative embodiment of the present invention. The header assembly 150 includes a board mount interface 166 that is configured to mount on top of the printed circuit board 16.

The header assembly 150 differs from the header assembly 14 shown with respect to FIG. 8, for example, in that the header assembly 150 is a straight header assembly 150 and not a right-angled assembly. Also, the header assembly 150 connects to the printed circuit board 16 such that the printed circuit board 16 is oriented differently with respect to the PC card 38. As shown in FIG. 1, for example, the header assembly 14 is configured to connect the printed circuit board 16 to the receptacle assembly 12 such that the plane of the printed circuit board 16 is parallel to the plane of the PC card 38. However, the header assembly 150 is configured to connect the printed circuit board 16 to the receptacle assembly 12 such that the plane of the printed circuit board 16 is perpendicular to the plane of the PC card 38.

Thus, embodiments of the present invention provide a connector that houses more contacts, thereby allowing greater signal and power transmission between a printed circuit board and a PC card. Additionally, embodiments of the present invention provide a shielded receptacle assembly that reduces the risk of electrostatic discharge, electrical interference and the like within the receptacle assembly, specifically, and the electrical connector, in general.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical connector, comprising a header assembly configured to be mounted on a first circuit board and a receptacle assembly configured to mate with a second circuit board, said receptacle assembly comprising:

a main housing including a top surface, a bottom surface, a header interface end having a plurality of contact cavities, and a board reception end having a plurality of contact receptacles, each of said contact receptacles communicating with a corresponding one of said contact cavities:

a plurality of electrical contacts retained within said contact receptacles;

a ground contact retained within one of said contact receptacles a first ground shield having a first shield strip overlying one of said top and bottom surfaces; and a ground clasp formed integrally with said first shield strip, said ground clasp extending from said first shield strip and engaging said ground contact.

2. The electrical connector of claim 1, further comprising a second ground shield having a second shield strip overlying another of said top and bottom surfaces, said second shield strip including a ground tail extending outwardly from said second shield strip, said ground tail being aligned with the second circuit board.

3. The electrical connector of claim 1, wherein said ground clasp is bent downward to extend into alignment with a corresponding one of said plurality of contact receptacles, said ground clasp interconnecting said first shield strip to said ground contact extending outwardly from said one of said plurality of contact receptacles.

4. The electrical connector of claim 1, wherein said electrical contacts are aligned in at least a first row, said ground contact being aligned in said first row of said electrical contacts.

5. The electrical connector of claim 1, wherein each of said plurality of electrical contacts includes a retained portion integrally formed with a contact tail, each of said contact tails extending outwardly from one of said plurality of contact receptacles, and each of said retained portions being housed within one of said plurality of contact cavities.

6. The electrical connector of claim 1, wherein said plurality of electrical contacts are arranged in at least two parallel rows and are configured such that the first circuit board is sandwiched between said at least two parallel rows.

7. The electrical connector of claim 1, wherein said first ground shield includes housing securing members that fold over side portions of said main housing.

8. The electrical connector of claim 1, wherein said header assembly is one of a right-angled and straight header assembly.

9. A receptacle assembly, comprising:

a main housing having a header interface end configured to mate with a header assembly, said main housing having a board reception end that retains a plurality of electrical contacts arranged in at least three parallel rows, wherein at least two rows of said electrical contacts are configured to contact one surface of a circuit card while at least one row of said electrical contacts is configured to contact an opposite surface of the circuit card; and at least one ground shield at least partially covering said main housing, said at least one ground shield being formed integrally with a ground contact that directly engages a ground pad on the circuit card.

10. The receptacle assembly of claim 9, wherein said at least two rows of electrical contacts include first and second contact tails that are spaced first and second different distances from said board interface end to engage first and second rows of contact pads on the circuit card.

11. The receptacle assembly of claim 9, wherein said at least one ground shield includes housing securing members that fold over side portions of said main housing.

12. The receptacle assembly of claim 9, wherein said at least one ground shield includes a shield strip, said shield strip includes a ground clasp formed integrally therewith, said ground clasp engaging a ground contact retained within said main housing.

* * * * *